US005372569A

United States Patent [19]

Ballos, III

[11] Patent Number: 5,372,569

[45] Date of Patent: Dec. 13, 1994

[54] METHOD AND APPARATUS FOR POSITIONING COLLAPSED SLOTTED BOXES IN A BOX ERECTOR

[75] Inventor: Pete Ballos, III, Canton, Ohio

[73] Assignee: IMBX Corporation, Canton, Ohio

[21] Appl. No.: 968,432

[22] Filed: Oct. 29, 1992

[51] Int. Cl.[5] ..... B31B 3/76; B65G 1/06; B65G 60/00

[52] U.S. Cl. ..... 493/316; 493/10; 493/34; 493/417; 414/789.9; 414/900; 414/924

[58] Field of Search ..... 414/798.9, 902, 924, 414/926; 493/10, 29, 122, 123, 124, 125, 316, 317, 34, 417

[56] References Cited

U.S. PATENT DOCUMENTS

| | | | |
|---|---|---|---|
| 2,478,794 | 8/1949 | Vail | 493/10 |
| 2,572,509 | 10/1951 | Novick | 414/798.9 |
| 3,130,967 | 4/1964 | Brell | 414/798.9 |
| 3,323,283 | 6/1967 | Johnson, Jr. | 53/186 |
| 3,352,215 | 11/1967 | Wainberg | 414/798.9 |
| 3,527,367 | 9/1970 | Bivans | 414/798.9 |
| 4,079,573 | 3/1978 | Livingston | 53/77 |
| 4,169,406 | 10/1979 | Tanham | 493/10 |
| 4,224,781 | 9/1980 | Salenbo | 53/473 |
| 4,273,322 | 6/1981 | Ginther et al. | 4393/122 |
| 4,285,679 | 8/1981 | Wahle | 493/125 |
| 4,398,381 | 8/1983 | Ulrich et al. | 53/393 |
| 4,437,851 | 3/1984 | Salenbo | 493/124 |
| 4,439,174 | 3/1984 | Derderian | 493/125 |
| 4,579,551 | 4/1986 | Ulrich et al. | 493/23 |
| 4,582,463 | 4/1986 | Schreiner | 414/926 |
| 4,632,666 | 12/1986 | Ulrich et al. | 493/23 |
| 4,919,589 | 4/1990 | Krappitz et al. | 414/798.9 |
| 5,116,303 | 5/1992 | Diejrich et al. | 493/316 |

FOREIGN PATENT DOCUMENTS

| | | | |
|---|---|---|---|
| 0186619 | 7/1986 | European Pat. Off. | 493/316 |
| 361010 | 1/1974 | Sweden . | |

*Primary Examiner*—William E. Terrell
*Attorney, Agent, or Firm*—Michael Sand Co.

[57] ABSTRACT

A method and apparatus for accurately positioning a plurality of slotted boxes which are in a flat collapsed state, in a magazine of a box erector. The box erector handles and sets up the boxes into a position having an open top for subsequently receiving items therein while moving bottom closure flaps into a generally closed position. A laser unit is mounted adjacent a box supply loading magazine of the box erector and projects a beam of light against a box placed in the magazine. The magazine then is adjusted until the fixed light beam strikes a predetermined location on the box, preferably the end of a slot formed between adjacent major and minor flaps of the box. This light beam strike location correlates with a location at an unfold station of the erector which receives a bottom corner of the box. The accurate positioning of the box at the magazine ensures accurate movement and erection of the box by the remaining components of the erector as the box, and all subsequent boxes of the same size, are automatically moved through the erector.

15 Claims, 5 Drawing Sheets

METHOD AND APPARATUS FOR POSITIONING COLLAPSED SLOTTED BOXES IN A BOX ERECTOR

BACKGROUND OF THE INVENTION

1. Technical Field

The invention relates to box erectors and in particular to erectors for handling and setting up slotted boxes from a flat collapsed position to an open position ready for receiving articles therein. More particularly, the invention relates to such a method and apparatus for accurately positioning the collapsed slotted boxes in a magazine of the box erector, whereby the boxes are in correct position for subsequent movement and manipulation as they move along the actuating mechanisms of the box erector.

2. Background Information

The packaging industry utilizes today a vast number of boxes in which numerous products are packaged for subsequent shipment. Many of these boxes are referred to as slotted boxes or cases known as an RSC (regular slotted case) and are shipped to a packaging company as stacks of flat collapsed boxes for ease of handling and shipment. After arriving at the packaging company, the flat collapsed boxes are placed in a box erecting apparatus or erector, usually located immediately adjacent a packaging machine. These box erectors automatically remove the collapsed boxes individually from the magazine and by various mechanisms, move the boxes to an unfolded open position, immediately afterwhich the erector automatically moves a pair of minor and major closure flaps on the bottom of the box to a closed position so that the box upon reaching the end of the erector, is in a top open position so that the articles to be contained therein, can be inserted manually or automatically into the open top of the erected box. Examples of such prior art box handling and erecting equipment and apparatus are shown in U.S. Pat. Nos. 3,323,283, 4,398,381, 4,285,679, 4,079,573, 4,224,781, 4,437,851, 4,579,551 and 4,632,666.

These prior art box erectors usually provide some mechanism for removing one box at a time from the magazine, such as by vacuum operated suction cups, afterwhich the pulled box is either moved open or still in its folded position, to an unfold station where the box is unfolded and then moved to a closure station where the major and minor flaps are closed upon themselves and subsequently either sealed or held in the closed position for sealing, with the top flaps remaining open enabling articles to be conveniently placed in the box through the top opening.

It is critical for the proper operation of the box erector that the boxes when removed from the magazine, be in an exact position for subsequent movement by the appropriate conveying and carriage mechanisms of the erector to the next station, for subsequent manipulation. If the boxes are out of alignment when placed in the magazine, they will be incorrectly positioned preventing proper functioning of the erecting apparatus resulting in malfunction of the box erector and/or improper closure of the box flaps.

Heretofore the supply magazines are provided with adjusting mechanisms whereby an operator will raise and lower, and move horizontally sideways the magazine containing a supply of boxes until the box erector is properly operating. However, this involves setup and adjusting time, and operation of the erector through several cycles until the proper setting of the magazine is achieved. This becomes particularly troublesome when a number of different size boxes are fed through the erector throughout a work shift, requiring constant resetting of the machine for each different size box.

Therefore, there is a need for an improved apparatus and method for correctly and accurately positioning a plurality of collapsed slotted boxes in the supply magazine of a box erector to ensure that the supply of boxes is correctly positioned so that when the individual boxes are removed from the supply, they are in the correct position for subsequent manipulation and movement through the box erector.

SUMMARY OF THE INVENTION

Objectives of the invention include providing a method and apparatus for positioning a plurality of collapsed slotted boxes in the magazine of a box erector which provides an easily recognized visual reference point to enable the operator to adjust the magazine so that once the reference point is achieved on one of the boxes in the magazine, the magazine will be in the correct position for subsequent movement of all subsequently withdrawn boxes through the erector mechanism, until the boxes reach a discharge station.

Still another objective is to provide such a method and apparatus which can be utilized with known types of box erectors without requiring major modification and changes to the erectors nor to their modes of operation.

A further objective of the invention is to provide such a method and apparatus which is achieved inexpensively by the use of a light source such as a laser unit, which once mounted and correctly positioned on the erector, requires no further manipulation except for producing a light beam which serves as the marking element against one of the boxes in the magazine.

Another objective of the invention is to provide such an improved method and apparatus in which the positioning light beam will not interfere with the operation of the other components of the erector, and which is usable with a variety of box sizes since the reference point at which the light beam strikes one of the boxes, correlates with a fixed reference point at an unfold station of the erector, thereby eliminating movement or adjustment of the light source regardless of the size of box which is placed in the supply magazine.

A still further objective is to provide such a method and apparatus which enables the results to be achieved in an extremely simple and inexpensive manner with a minimum amount of components, which is free of moving parts, and which will reduce setup time and adjustments heretofore required for setting the box erector for different sizes of boxes.

These objectives and advantages are obtained by the improved method of the invention, the general nature of which may be stated as a method for handling and setting up slotted boxes in a magazine of a box erecting apparatus of the type in which a plurality of the boxes are maintained in the magazine in a generally flat collapsed state for subsequent removal and erection into an unfolded assembled position by the erecting apparatus, the method comprises the steps of placing a collapsed box in the magazine adapted to hold a plurality of collapsed boxes; projecting a light beam onto the box in the magazine; adjusting the position of the box in the magazine by adjusting the magazine so that the light beam strikes the box at a predetermined position on the box; and placing a plurality of the collapsed boxes in the magazine after the magazine has been adjusted for subsequent removal and erection by the apparatus.

These objectives and advantages are further obtained by the improved apparatus of the invention, the general nature of which may be stated as apparatus for handling and setting up slotted boxes in which the boxes are formed by sides, two of which sides have opposed bottom minor flaps connected thereto and two other sides of which have opposed major flaps connected thereto for closing a bottom of the box, comprising a magazine for receiving a plurality of generally flat collapsed slotted boxes; light source means for directing a beam of light against one of the boxes in the magazine; and means for adjusting the position of the boxes whereby the beam of light strikes the said one box at a predetermined position which correlates to a subsequent position the box assumes in the apparatus.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
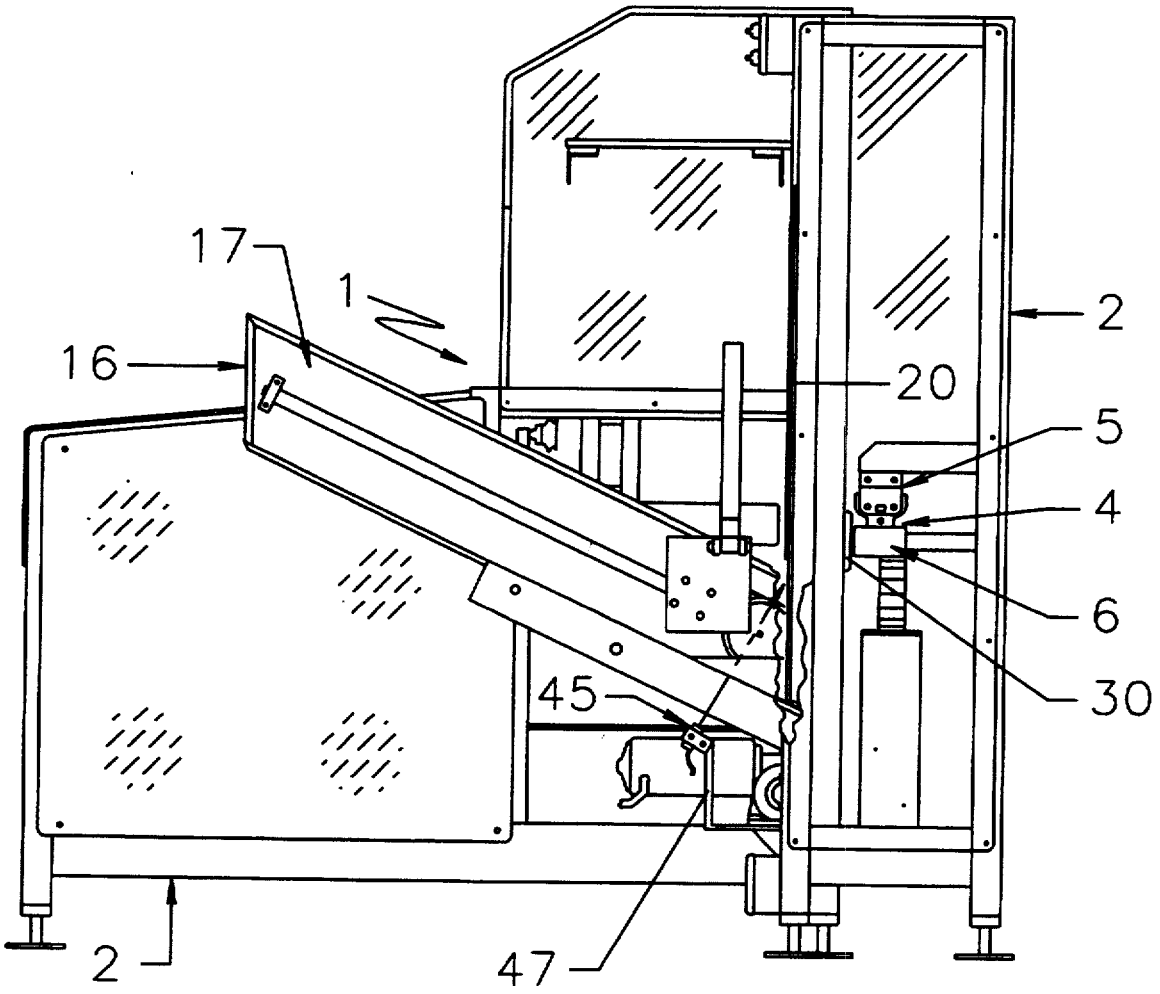
FIG. 1 is a generally diagrammatic side elevational view of a box erector incorporating the improved positioning light source therein.
Figure 2:
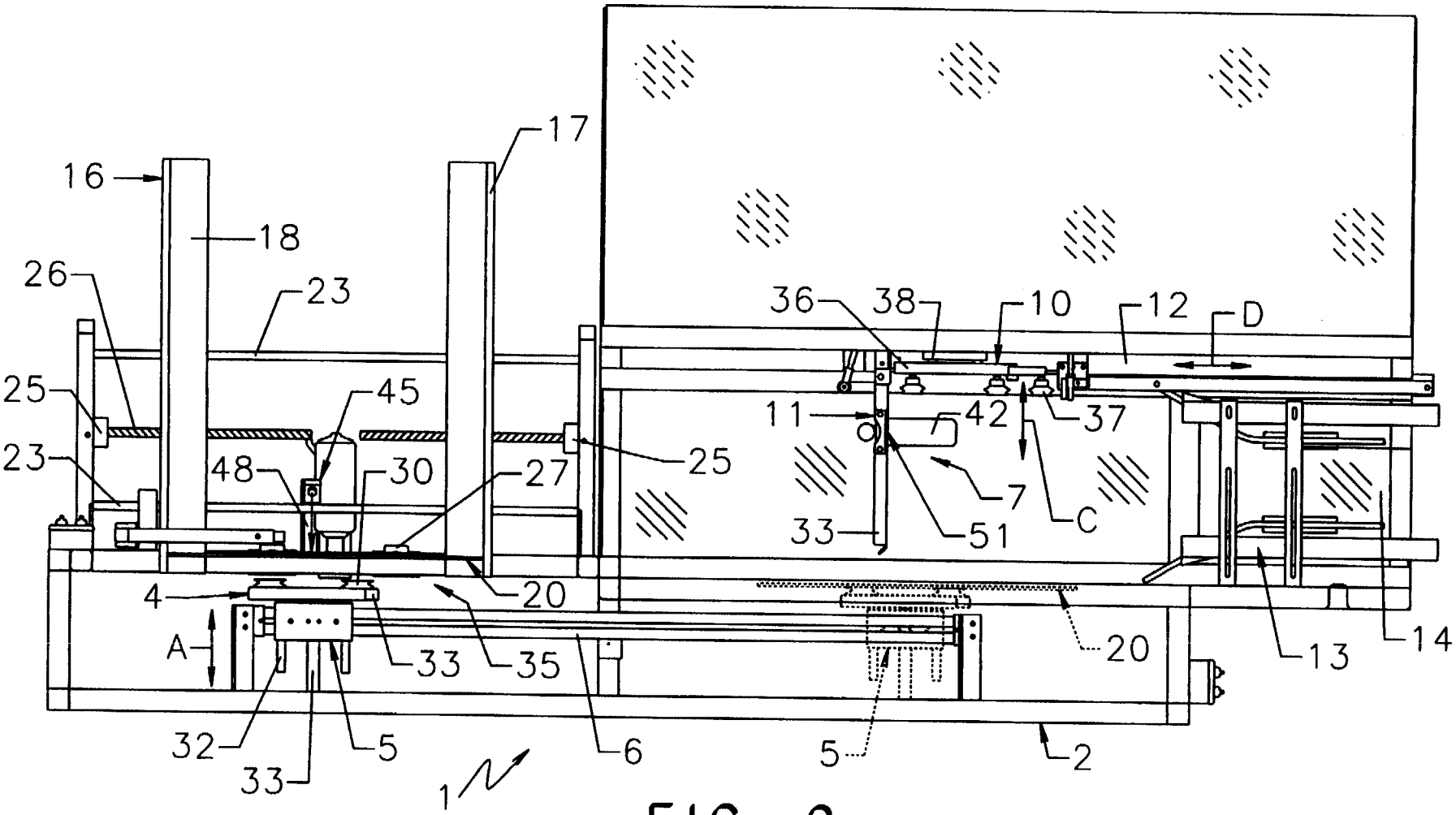
FIG. 2 is a top plan view of the box erector as shown in FIG. 1.
Figure 3:
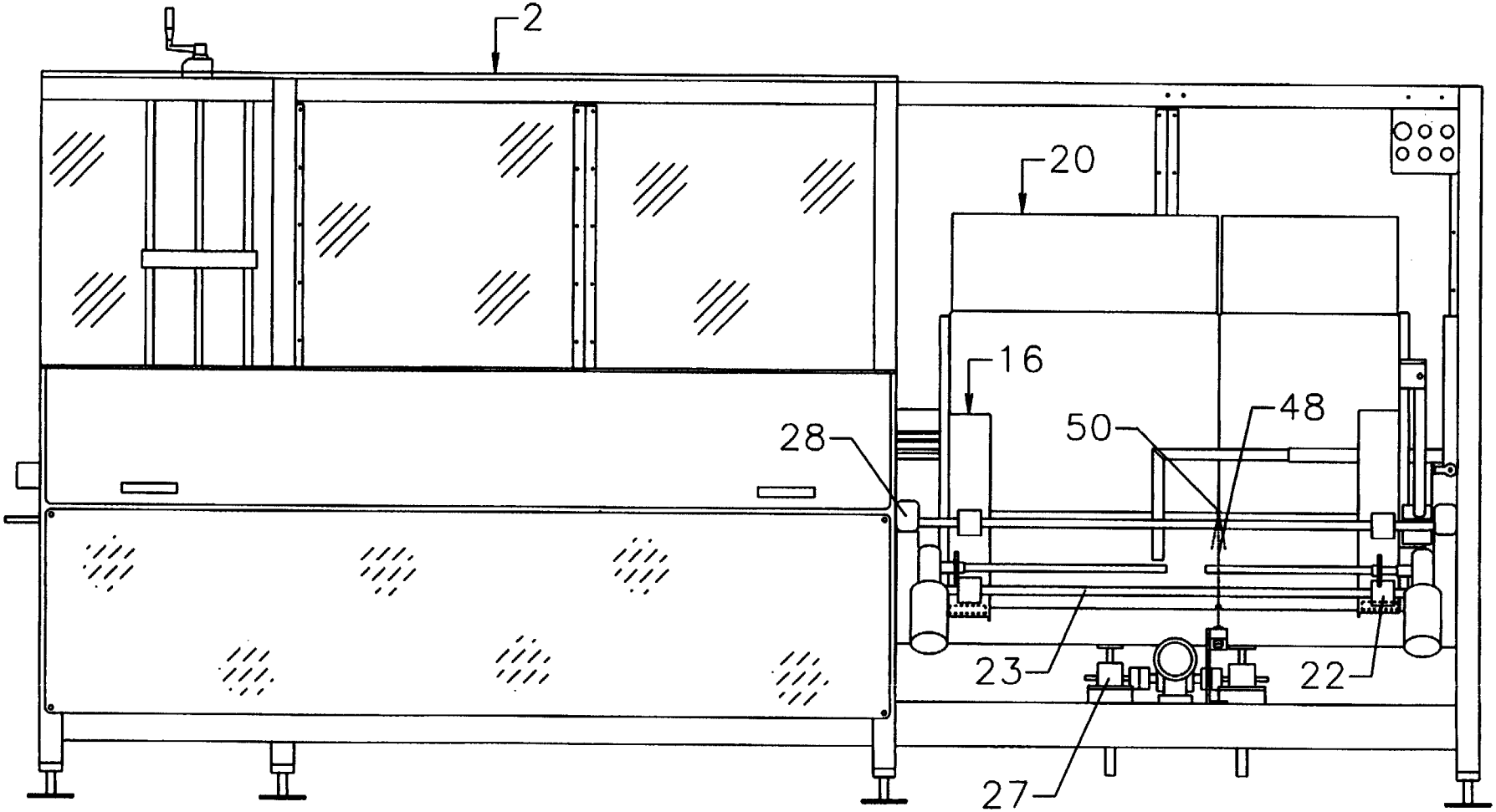
FIG. 3 is a rear elevational view of the box erector of FIG. 1.

One type of box erector with which the improved positioning apparatus is utilized is shown in FIGS. 1–3, and is indicated generally at 1. Erector 1 is similar in many features to the erector shown in U.S. Pat. No. 4,285,679, the contents of which are incorporated herein by reference. Erector 1 includes a main support frame 2 formed by a plurality of vertical and horizontal frame members, and includes as its principle subassemblies a supply magazine indicated generally at 3, a suction pullout or picker mechanism indicated generally at 4, a carriage mechanism indicated generally at 5, and a rodless pneumatic cylinder guide track indicated generally at 6, for moving picker mechanism 4 and carriage 5 from a pickup station located at the discharge end of magazine 3, to an unfold station indicated generally at 7 (FIG. 2). A second suction actuated picker mechanism 10 is located at unfold station 7, and is mounted on a carriage 11 which is moved along another pneumatic cylinder guide track 12 to a flap closure station indicated generally at 13, adjacent a discharge end 14 of box erector 1.

Figure 4:
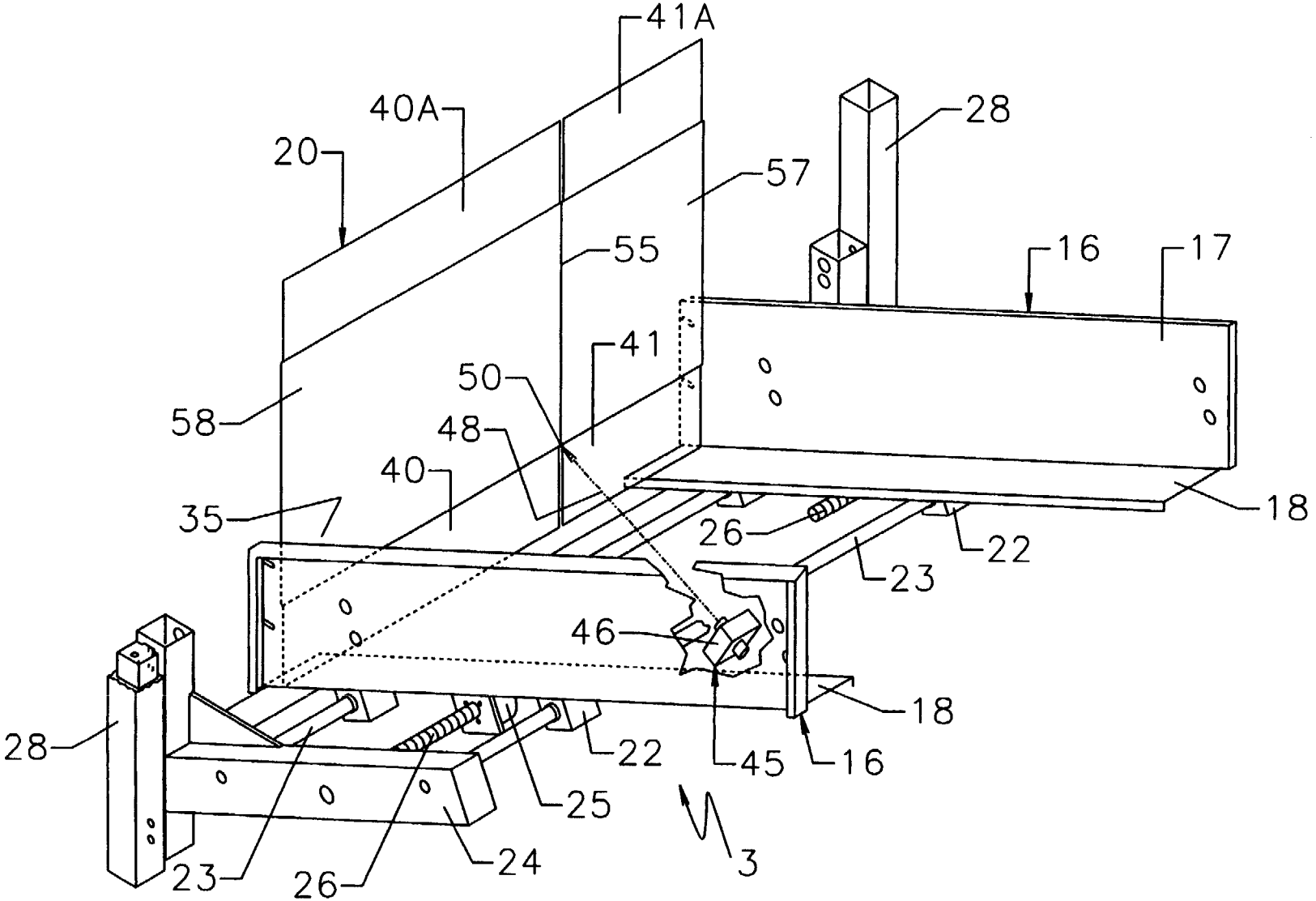
FIG. 4 is a fragmentary diagrammatic view with portions broken away, of the supply magazine of the box erector of FIGS. 1–3, showing the positioning light source acting upon a single box placed at the discharge end of the magazine.

Supply magazine 3 is shown particularly in FIGS. 1–4 and includes a pair of independently adjustable spaced parallel L-shaped guide frame members 16, each comprised of a vertical side frame 17 and a bottom member 18. Bottom members 18 provide the main support for holding a plurality of slotted boxes 20, one of which is shown particularly in FIG. 4. Magazine 3 is adjustably mounted with respect to frame 2 by a variety of manually and/or power actuated mechanisms well known in the art. In the particular embodiment shown in the drawings, guide frame members 16 are independently slidably mounted by bearings 22 on slide bars 23 which extend generally horizontally between a pair of spaced frame members 24 and can be moved therealong either manually by a handcrank, motor drive or other well known mechanism. In the embodiment shown in the drawings, a pair of motors 25 move frame members 16 by screw shafts 26. Magazine 3 also is movable in the vertical direction by a motor actuated jack screw 27 (FIG. 3), which moves magazine 3 along a pair of vertical frame members 28 as shown in FIG. 4.

Referring particularly to FIG. 2, pullout picker 4 includes a plurality of vacuum actuated suction cups 30 which are mounted on a pickup plate 31. Plate 31 is mounted on a plurality of slide rods 32 and is moved therealong by a pressure actuated cylinder 33 or other control mechanism, for movement in a general horizontal plane as indicated by arrow A, towards and away from a discharge end 35 of supply magazine 3. Picker carriage 5 is movably mounted on rodless pneumatic cylinder 6 for horizontal movement therealong in the direction of arrow B, until it reaches a position in front of box unfold station 7 as shown in dash lines in FIG. 2.

When at the unfold station, carriage 5 is in alignment with suction picker mechanism 10. Mechanism 10 includes a plurality of suction cups 37 mounted on a pickup plate 36 which is slidably moved towards and away from carriage 5 in a general horizontal plane designated by arrows C, by slide rods 38, for cooperation with picker mechanism 4 for moving collapsed box 20 into an unfolded position. Carriage 11 also includes a pair of box positioning arms 42 and 43 which meet at a right angle for containing an unfolded box thereon as the carriage moves along cylinder 12. Again such a picker mechanism is well known in the art.

Carriage 11 also is slidably mounted for movement along rodless cylinder 12 in a general horizontal plane in the direction of arrow D (FIG. 2), so as to move an unfolded box horizontally from unfold station 7 to flap closure station 13. Closure station 13 may be similar to that shown in U.S. Pat. No. 4,224,781, the contents of which are incorporated herein by reference, or may contain other types of flaps folding mechanisms which automatically fold a bottom pair of minor flaps 40 (FIG. 4) of slotted box 20 into a closed position, followed by the subsequent folding of a pair of major flaps 41 to closed position, for subsequent sealing with tape, glue or other closure means. As shown in FIG. 4, box 20 may have top major and minor flaps 40A and 41A respectively, although certain types of boxes may be completely open at the top having only bottom closure flaps. Likewise, although the terms major and minor flaps are used, the flaps can be of equal size where the box is square in cross-sectional configuration.

The particular box erector 1 described above and shown in the drawings is a type of mechanism presently used in the box erecting art and may be modified without affecting the concept of the invention.

Figure 5:
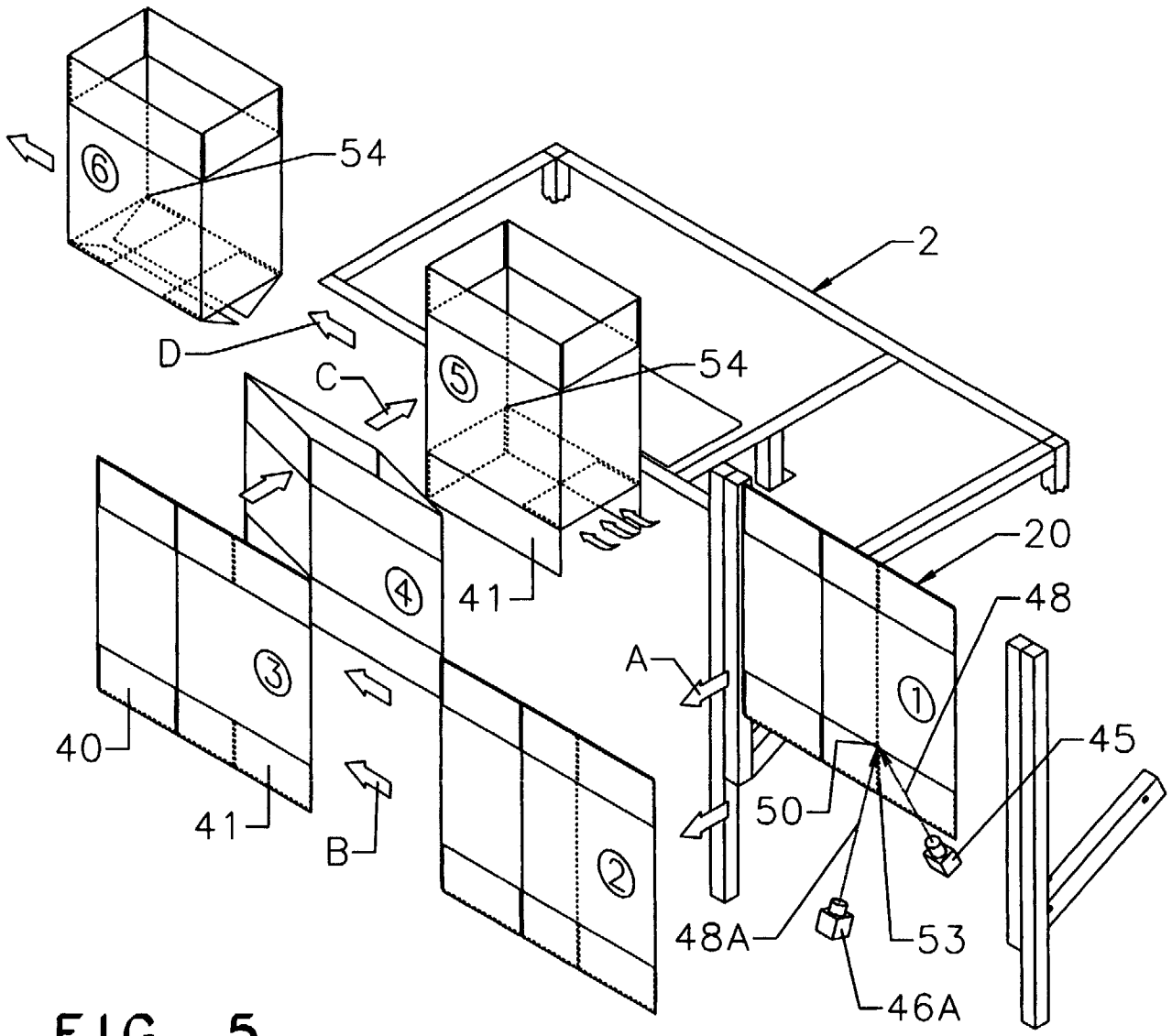
FIG. 5 is a diagrammatic view showing the movement of a single box from the supply magazine to the discharge station of the box erector.

In accordance with the invention, a light source indicated generally at 45, is mounted beneath supply magazine 3, and in the particular embodiment shown, includes an emitter 46 which is mounted by a bracket 47 onto main support frame 2. Emitter 46 may be of the type manufactured by Imatronic and is identified as a diode laser, EDU Grade, Model No. LDL 175/670/3, which will emit a red beam 48 toward discharge end 35 of supply magazine 3. In the particular example shown in the drawings, emitter 46 is mounted beneath magazine 3 between its supply end and discharge end and projects light beam 48 upwardly and forwardly towards the magazine discharge end. If desired, an emitter 46A can be mounted beyond the discharge end of magazine 3 as shown in FIG. 5, and project its light beam 48A toward the discharge end of the magazine, without affecting the concept of the invention. The particular location of the emitter is best determined by the particular type of box erector with which it will be used, and the available space and best location on the erector for mounting the same.

The operation of the improved light beam positioning apparatus and method for using the same is set forth below. After magazine 3 is set to a general size and position for a particular size box 20, a box 20 is placed at the discharge end of magazine 3 as shown in FIGS. 2 and 4, in a vertical upright position. The point at which light beam 48 strikes box 20 after being placed at the discharge end of the magazine, is referred to as the strike point, and is indicated at 50. This strike point has been predetermined and correlates with a corner point 51 (FIGS. 2 and 5) which is a fixed position on carriage 12 at the corner junction of box positioning arms 42 and 43, when carriage 12 is in an at-rest position at unfold station 7, against which a lower rear corner 54 of the box when unfolded must rest, in order for box 20 to be in the correct position for proceeding correctly into and through flap closure station 13.

Light beam strike point 50 corresponds to the location on the box which becomes lower end corner 51 and is located at the upper ends of minor and major flaps 40 and 41 at the upper closed end of a slot 53 which separates flaps 40 and 41, and at fold line 55 of a pair of box sides 57 and 58. Thus, strike point 50 when the box is folded at the discharge end of the magazine, corresponds to corner point 51 at unfold station 7, which corresponds to lower rear corner 54 of box 20.

Thus, for a particular box erector, strike point 50 is a known location on a box located at the discharge station of the erector so that when the box is removed by pullout picker 4 and moved along guide cylinder 6 on carriage 5, and then subsequently moved into an unfolded position by the mutual action of pullout picker 4 and picker 10 of unfold carriage 11, lower rear box corner 54 is abutted snugly against corner point 51 at unfold station 7 between positioning arms 42 and 43. Therefore, if supply magazine 3 is not accurately positioned after receiving its supply of boxes 20, so that the lower corner of the box at the junction of minor and major flaps 40 and 41 and box sidewalls 57 and 58, are not at light beam strike point 50, the box upon being unfolded at station 7 will not be properly aligned therein for subsequent movement of the box along cylinder 12 by carriage 11, and for subsequent movement of the flaps to the closed position after being moved to flap closure station 13. Thus, the adjustment of supply magazine 3 is critical for the satisfactory operation of erector 1.

After setup box 20 is placed at the discharge end of magazine 3, the magazine is adjusted by movement of guide frames 16 inwardly to meet with the side edges of folded box 20, and then adjusted vertically by jack screw 27 until corner point 51 corresponds with strike point 50 of light beam 48. When the box assumes this position, the magazine is then properly adjusted both horizontally and vertically, for a particular size of box 20, so that all subsequent boxes which are stacked behind box 20 on guide frames 16, will be correctly positioned and carried by picker mechanism 4 so that when they are unfolded by suction picker 10 at unfold station 7, lower rear box corner 54 will be at corner position 51 of unfold station 7. This assures that the bottom box flaps are in position for subsequent closure upon moving through closure station 13.

By choosing a particular type of laser emitter 46 the desired point of light can be produced which is easily seen on a box 20 when placed at the discharge end of magazine 3, enabling the magazine to be adjusted in both the horizontal and vertical directions until strike point 50 corresponds with box corner 51.

Although a laser light source and a red beam of light is preferred, it is readily seen that other types of light sources and beams can be utilized so long as a point of light is provided at the discharge end of the magazine for impingement upon a box placed therein. For example, fiber optics could provide such a light beam.

It is readily understood that if the light source is placed in front of the discharge end of magazine 3 as indicated by emitter 46A and light beam 48A, that the strike point on the box is in the inverse relationship to the corner point 51 as discussed previously and as shown on FIG. 4. Thus, after the magazine has been properly adjusted, the supply of boxes are flipped from the position of the setup box upon being placed in stacked condition in magazine 3.

Thus, it is readily seen that after the mounting and positioning of a single light source adjacent supply magazine 3 and the positioning of the strike point of the emitted beam with respect to a box at the discharge end of the magazine, such an arrangement will ensure that all subsequent boxes picked out of the supply of boxes and delivered to the unfold station will be in the correct position for unfolding of the box, and in the correct position for the subsequent closure of the bottom flaps to the flap closure station.

Thus, all that a worker need do to setup magazine 3, is to place a box at the discharge end of magazine guide frame 16 in a proper oriented position and move the magazine, and in particular frame members 16 vertically and horizontally, until corner point 51 at the closed end of box slot 53 aligns with strike point 50 of the light beam. This ensures that the magazine is correctly positioned for discharge of the boxes without requiring any trial an error operation of the machine or movement of sample boxes along the erection path.

Thus, the improved apparatus and method provides a simple, inexpensive means and method to ensure the correct positioning of the supply magazine and boxes therein for subsequent movement along the erector, so that adjustment for various size boxes can be made each time a box size changes with a minimum amount of downtime, and which can be performed by a relatively unskilled worker.

Accordingly, the box erector and method is simplified, provides an effective, safe, inexpensive, and efficient device and method which achieves all the enumerated objectives, provides for eliminating difficulties encountered with prior devices and methods, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved box erector is constructed and used, the characteristics of the construction, and the advantageous, new and useful results obtained; the new and useful structures, devices, elements, arrangements, parts and combinations, and method steps, are set forth in the appended claims.

I claim:

1. A method for handling and setting up slotted boxes in a magazine of a box erecting apparatus of the type in which a plurality of said boxes are maintained in the magazine in a generally flat collapsed state for subsequent removal and erection into an unfolded assembled position by the erecting apparatus, said method comprises the steps of:

placing a collapsed box in the magazine adapted to hold a plurality of said collapsed boxes, said box having two pairs of bottom closure flaps with a slot being formed between each pair of adjacent flaps;

projecting a fixed visible light beam onto the box in the magazine;

adjusting the position of the box until the fixed light beam strikes the box at an end of one of the slots at a junction of a pair of said flaps, which end corresponds to a bottom corner of the box when said box is erected; and then placing a plurality of the collapsed boxes in the magazine in the same orientation as said collapsed box after said box has been adjusted, for subsequent removal and erection of said boxes by said apparatus.

2. The method as defined in claim 1 including the step of directing the beam of light toward said end of said one slot on a front surface of a collapsed box at a discharge end of the magazine.

3. The method as defined in claim 1 including the step of directing the beam of light toward said end of said one slot on a rear surface of a collapsed box at a discharge end of the magazine.

4. The method as defined in claim 1 including the steps of pulling a collapsed box from the magazine; and then moving said pulled box to an unfolded station, while said box remains in a collapsed state.

5. The method as defined in claim 4 including the steps of unfolding the collapsed box at the unfold station into an open state; then moving said open box to a flap closure station; and then moving the flaps into a folded state with respect to each other.

6. The method as defined in claim 1 in which the light beam is a beam of red light emitted by a laser unit.

7. The method as defined in claim 1 in which the step of adjusting the position of the box includes moving the magazine both vertically and horizontally until said fixed light beam strikes said box at the end of said one slot on said box.

8. In combination, a slotted box formed by sides, two of which sides have a first pair of opposed bottom flaps connected thereto and two other sides which have a second pair of opposed flaps connected thereto for closing a bottom of the box, said adjacent flaps being separated by slots; and an apparatus for handling and erecting said boxes; said apparatus including:

a magazine for receiving said box in a flat collapsed condition;

fixed light source means for directing a visible beam of light toward said box in the magazine; and means for vertically and horizontally adjusting the position of said magazine and box received therein until the visible beam of light strikes the box at an end of one of the slots, which end corresponds to a bottom corner of said box when erected in said apparatus.

9. The combination as defined in claim 8 including first picker means for pulling the collapsed box out of the magazine; and first carriage means for moving the first picker means and pulled box from adjacent the magazine to an unfold station.

10. The combination as defined in claim 9 including second picker means at the unfold station for moving the collapsed box into an unfolded open position in cooperation with the first picker means.

11. The combination as defined in claim 10 including closure means for folding the flaps into a folded position to close a bottom of the box; and second carriage means for moving the unfolded open box to said closure means.

12. The combination as defined in claim 8 in which the light source means is a laser unit which emits a beam of red light.

13. The combination as defined in claim 12 in which the magazine has a discharge end and a supply end; and in which the laser unit is mounted beneath the magazine and between said supply and discharge ends whereby the beam of light is direct toward a rear surface of said collapsed box.

14. The combination as defined in claim 12 in which the magazine has a discharge end and a supply end; and in which the laser unit is mounted forward of the discharge end of the magazine whereby the beam of light is directed toward a front surface of a collapsed box.

15. The combination defined in claim 8 in which the flaps are a pair of opposed major flaps and a pair of opposed minor flaps.

* * * * *